US009937721B2

(12) United States Patent
Kurogochi et al.

(10) Patent No.: US 9,937,721 B2
(45) Date of Patent: Apr. 10, 2018

(54) PRINTING APPARATUS

(71) Applicant: SEIKO EPSON CORPORATION, Tokyo (JP)

(72) Inventors: Yoichi Kurogochi, Nagano (JP); Kentaro Tanabe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/644,959

(22) Filed: Jul. 10, 2017

(65) Prior Publication Data

US 2017/0305160 A1 Oct. 26, 2017

Related U.S. Application Data

(63) Continuation of application No. 15/297,705, filed on Oct. 19, 2016, now Pat. No. 9,731,511.

(30) Foreign Application Priority Data

Nov. 6, 2015 (JP) ..... 2015-218098

(51) Int. Cl.
*B41J 2/165* (2006.01)

(52) U.S. Cl.
CPC ..... *B41J 2/16523* (2013.01); *B41J 2/16535* (2013.01)

(58) Field of Classification Search
CPC .... B41J 2/16535; B41J 29/38; B41J 2202/20; B41J 2/16508; B41J 2/16552; B41J 2/16532; B41J 2/16538; B41J 2/16547; B41J 2/165; B41J 2/16523; B41J 2/16505; B41J 2/16511; B41J 2/16541; B41J 2/16517
USPC ..... 347/22, 23, 29–36
See application file for complete search history.

(56) References Cited

U.S. PATENT DOCUMENTS

| | | | | |
|---|---|---|---|---|
| 9,731,511 | B2 * | 8/2017 | Kurogochi | B41J 2/16523 |
| 2015/0336387 | A1 | 11/2015 | Miyazaki | |
| 2016/0052275 | A1 | 2/2016 | Naoe | |

FOREIGN PATENT DOCUMENTS

| | | | |
|---|---|---|---|
| JP | 11-058789 | A | 3/1999 |
| JP | 2004-106304 | A | 4/2004 |
| JP | 2006-341543 | A | 12/2006 |
| JP | 2013-173313 | A | 9/2013 |

* cited by examiner

*Primary Examiner* — Jannelle M Lebron

(57) ABSTRACT

A printing apparatus includes ejection heads configured to eject a liquid onto a medium, a plurality of sub-units each including an ejection head row configured by a plurality of the ejection heads, and a plurality of maintenance sections configured to sequentially perform maintenance on the sub-units. The plurality of the maintenance sections are configured such that positions of at least two of the plurality of the maintenance sections are aligned with positions of at least two of the plurality of the sub-units, respectively, while the at least two of the plurality of the maintenance sections perform the maintenance.

7 Claims, 12 Drawing Sheets

PRINTING APPARATUS

This application is a continuation application of U.S. patent application Ser. No. 15/297,705, filed on Oct. 19, 2016. This application claims priority to Japanese Patent Application No. 2015-218098 filed on Nov. 6, 2015. The entire disclosures of U.S. patent application Ser. No. 15/297,705 and Japanese Patent Application No. 2015-218098 are hereby incorporated herein by reference.

BACKGROUND

1. Technical Field

The present invention relates to a printing apparatus.

2. Related Art

Ink jet printing apparatuses are employed to print images or the like on a medium by ejecting a liquid such as ink from ejection heads that are provided with nozzles, toward the surface of a medium such as paper or fabric. Such printing apparatuses include maintenance sections that perform maintenance on the ejection heads to forestall ejection defects of the ink from the nozzles, or when ejection defects have arisen. Printing operation is stopped while performing maintenance operations on the ejection heads. In large scale printing apparatuses provided with plural ejection heads, maintenance can take a long time, and so proposals have been put forward for reducing printing operation downtime. For example, JP-A-2006-341543 describes an ink jet printing apparatus including two sets (two systems) of head units. During a maintenance operation on one of the head units, the other head unit performs a printing operation.

However, although the printing apparatus described in JP-A-2006-341543 is capable of reducing the maintenance time when a maintenance operation is performed partway through a printing operation, issues remain in that a long maintenance time is still required for maintenance operations prior to commencing printing, resulting in a drop in operation efficiency of the printing apparatus. Moreover, providing two head unit systems incurs an increase in the cost of the printing apparatus.

SUMMARY

The invention may be implemented by the following aspects and application examples.

A printing apparatus according to one aspect of the present invention includes ejection heads configured to eject a liquid onto a medium, plural sub-units each including an ejection head row configured by plural of the ejection heads, and plural maintenance sections configured to sequentially perform maintenance on the sub-units. The plurality of the maintenance sections are configured such that positions of at least two of the plurality of the maintenance sections are aligned with positions of at least two of the plurality of the sub-units, respectively, while the at least two of the plurality of the maintenance sections perform the maintenance.

According to the aspect of the invention, for a head pitch that is a spacing between centers of the ejection head rows, a spacing between centers of mutually adjacent of the maintenance sections is an integer multiple of the product of the head pitch with the number of the ejection head rows provided to each of the sub-units.

According to the aspect of the invention, preferably the plural maintenance sections include a suction section configured to apply suction to the ejection heads, a wiping section configured to remove the liquid, and a flushing section configured to eject liquid from the ejection heads.

According to the aspect of the invention, preferably each of the sub-units has two of the ejection head rows, and the spacing between centers of mutually adjacent of the maintenance sections is twice the head pitch.

According to the aspect of the invention, the plurality of the maintenance sections simultaneously are configured to perform different maintenance operations on the plurality of the sub-units as the maintenance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding an embodiment of the invention, with reference to the drawings. Note that in each of the following drawings, in order for the various layers and various members to be large enough to be seen, the various layers and various members are not shown to scale.

For ease of explanation, three mutually orthogonal axes of an X-axis, a Y-axis, and a Z-axis are shown in FIG. 1 to FIG. 7, and FIG. 10 to FIG. 13. The leading end side of each of the arrows indicating the directions of the axes is referred to as the "+ side", and the base end sides thereof are referred to as the "− side". In the following explanation, a direction parallel to the X-axis is referred to as the "X-axis direction", a direction parallel to the Y-axis is referred to as the "Y-axis direction", and a direction parallel to the Z-axis is referred to as the "Z-axis direction".

EMBODIMENT

Schematic Configuration of Printing Apparatus

Figure 1:
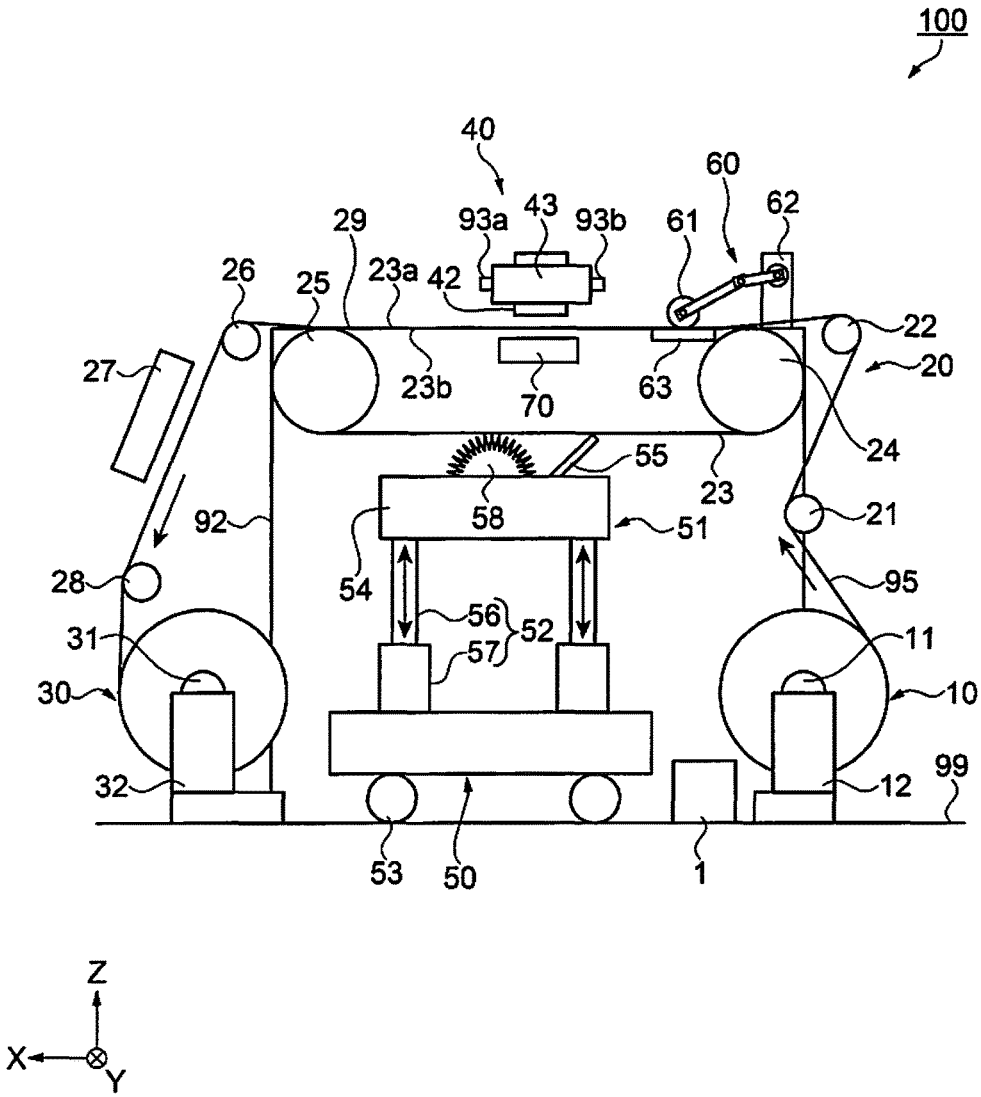
FIG. 1 is a schematic diagram illustrating a schematic overall configuration of a printing apparatus according to an embodiment.
Figure 2:
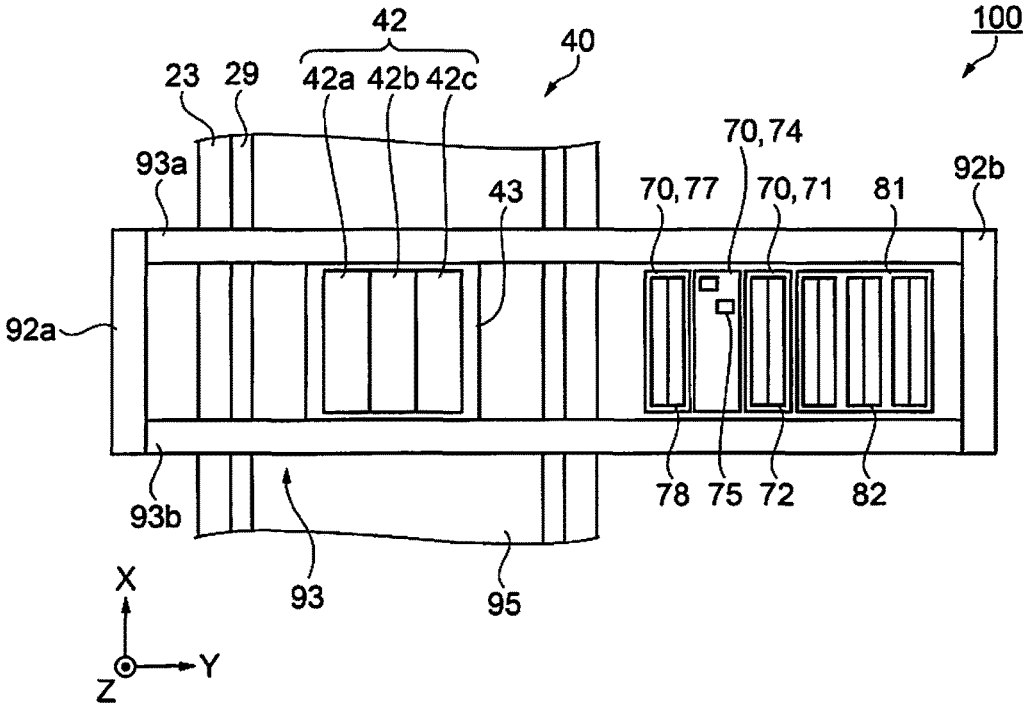
FIG. 2 is a plan view illustrating configuration of a printing section and maintenance sections.
Figure 3:
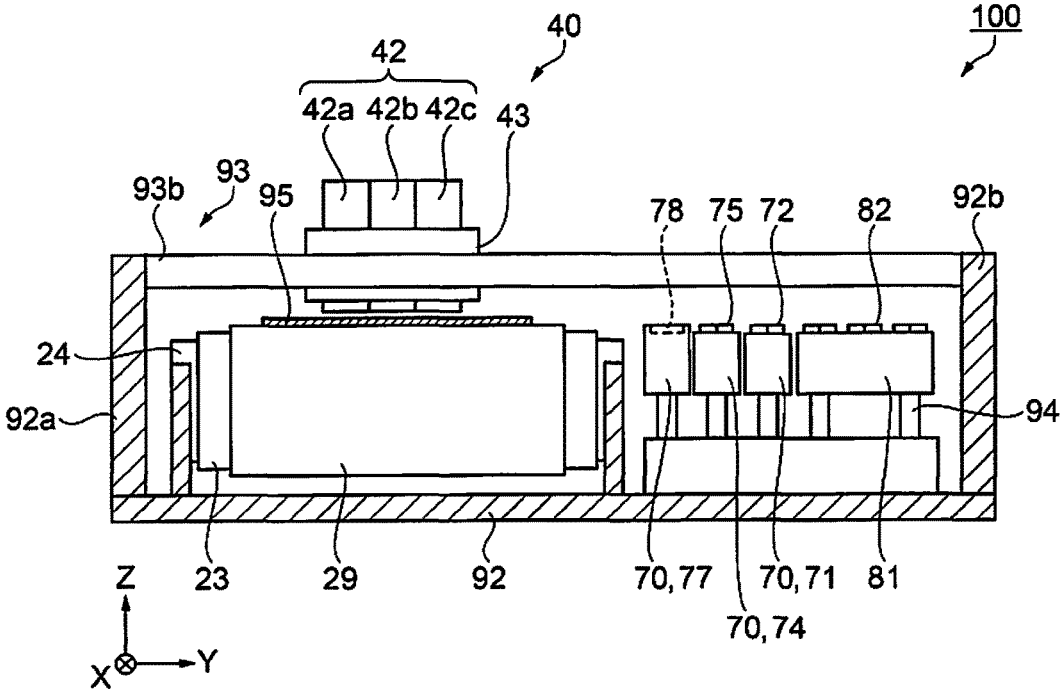
FIG. 3 is a side view illustrating configuration of a printing section and maintenance sections.

FIG. 1 is a schematic diagram illustrating a schematic overall configuration of a printing apparatus according to an embodiment. FIG. 2 is a plan view illustrating a configuration of a printing section and a maintenance section. FIG. 3 is a side view illustrating configuration of the printing section and the maintenance section. First, explanation follows regarding a schematic configuration of a printing apparatus 100 according to the present embodiment, with reference to FIG. 1 to FIG. 3. Note that in the present embodiment, explanation follows regarding an example in which the ink jet printing apparatus 100 prints on a medium 95 by forming images or the like on the medium 95.

As illustrated in FIG. 1, the printing apparatus 100 includes a medium feed section 10, a medium transport section 20, a medium collection section 30, a printing section 40, a washer unit 50, a medium adhesion section 60, and the like. The printing apparatus 100 further includes a controller 1 that controls the respective sections. The respective sections of the printing apparatus 100 are attached to a frame section 92.

The medium feed section 10 feeds the medium 95 to be formed with an image toward the printing section 40 side. For example, a cotton, wool, synthetic fiber, or blended fabric may be employed as the medium 95. The medium feed section 10 includes a feed shaft section 11 and a shaft bearing section 12. The feed shaft section 11 is formed in a circular cylinder shape or a circular column shape, and is provided so as to be capable of rotating in a circumferential direction. The belt shaped medium 95 is wound onto the feed shaft section 11 in a rolled up shape. The feed shaft section 11 is detachably attached to the shaft bearing section 12. The medium 95 can accordingly be attached to the shaft bearing section 12 together with the feed shaft section 11 in a pre-wound state on the feed shaft section 11.

The shaft bearing section 12 rotatably supports both axial direction ends of the feed shaft section 11. The medium feed section 10 includes a rotation drive section (not illustrated in the drawings) that drives rotation of the feed shaft section 11. The rotation drive section rotates the feed shaft section 11 in a direction to pay out the medium 95. Actuation of the rotation drive section is controlled by the controller 1.

The medium transport section 20 transports the medium 95 from the medium feed section 10 to the medium collection section 30. The medium transport section 20 includes a transport roller 21, a transport roller 22, an endless belt 23, a belt-rotated roller 24, a belt drive roller 25, a transport roller 26, a drying unit 27, and a transport roller 28. The transport rollers 21, 22 relay the medium 95 from the medium feed section 10 to the endless belt 23.

The endless belt 23 is formed in an endless shape by connecting together both ends of a strap shaped belt, and is entrained around the belt-rotated roller 24 and the belt drive roller 25. The endless belt 23 is retained in a state in which a specific tension is applied, such that a portion of the endless belt 23 between the belt-rotated roller 24 and the belt drive roller 25 runs parallel to a floor surface 99. A surface (support face) 23*a* of the endless belt 23 is provided with an adhesive layer 29 to which the medium 95 is made to stick. The endless belt 23 supports (retains) the medium 95 that has been fed from the transport roller 22 and adhered to the adhesive layer 29 by the medium adhesion section 60, described later. This thereby enables stretchable fabric and the like to be employed as the medium 95.

The belt-rotated roller 24 and the belt drive roller 25 support an inner peripheral face 23*b* of the endless belt 23. Note that configuration may be made in which support sections that support the endless belt 23 are provided between the belt-rotated roller 24 and the belt drive roller 25.

The belt drive roller 25 includes motors (not illustrated in the drawings) that drive rotation of the belt drive roller 25. When rotation of the belt drive roller 25 is driven, the endless belt 23 rotates accompanying the rotation of the belt drive roller 25, and the belt-rotated roller 24 is rotated by the rotation of the endless belt 23. The medium 95 supported by the endless belt 23 is transported in a specific transport direction (+X-axis direction) by the rotation of the endless belt 23, and an image is formed on the medium 95 by the printing section 40, described later. In the present embodiment, the medium 95 is supported on a side where the surface 23*a* of the endless belt 23 faces the printing section 40 (+Z-axis side), and the medium 95 is transported from the belt-rotated roller 24 side toward the belt drive roller 25 side, together with the endless belt 23. On a side where the surface 23*a* of the endless belt 23 faces the washer unit 50 (−Z-axis side), only the endless belt 23 moves from the belt drive roller 25 side to the belt-rotated roller 24 side.

The transport roller 26 peels the medium 95, on which an image has been formed, away from the adhesive layer 29 of the endless belt 23. The transport rollers 26, 28 relay the medium 95 from the endless belt 23 to the medium collection section 30.

The medium collection section 30 collects the medium 95 that has been transported by the medium transport section 20. The medium collection section 30 includes a take-up shaft section 31 and a shaft bearing section 32. The take-up shaft section 31 is formed in a circular cylinder shape or a circular column shape, and is provided so as to be capable of rotating in a circumferential direction. The belt shaped medium 95 is taken up onto the take-up shaft section 31 in a roll shape. The take-up shaft section 31 is detachably attached to the shaft bearing section 32. Accordingly, the medium 95 can be removed together with the take-up shaft section 31 in a state in which the medium 95 has been taken up onto the take-up shaft section 31.

The shaft bearing section 32 rotatably supports both axial direction ends of the take-up shaft section 31. The medium collection section 30 includes a rotation drive section (not illustrated in the drawings) that drives rotation of the take-up shaft section 31. The rotation drive section rotates the take-up shaft section 31 in a direction to take up the medium 95. Actuation of the rotation drive section is controlled by the controller 1.

Note that in the present embodiment, the drying unit 27 is disposed between the transport roller 26 and the transport roller 28. The drying unit 27 dries images formed on the medium. The drying unit 27 includes, for example, an IR heater, and driving the IR heater enables the images formed on the medium 95 to be dried in a short amount of time. The belt shaped medium 95 on which the images are formed can accordingly be taken up onto the take-up shaft section 31.

The medium adhesion section 60 makes the medium 95 adhere to the endless belt 23. The medium adhesion section 60 is disposed further to an upstream side (−X-axis side) than the printing section 40 in the transport direction of the medium 95. The medium adhesion section 60 includes a press roller 61, a press roller drive section 62, and a roller support section 63. The press roller 61 is formed in a circular cylinder shape or a circular column shape, and is provided so as to be capable of rotating in a circumferential direction. The press roller 61 is disposed with its axial direction intersecting the transport direction so as to rotate in a direction aligned with the transport direction. The roller support section 63 is provided at the inner peripheral face 23*b* side of the endless belt 23 so as to face the press roller 61 across the endless belt 23.

The press roller drive section 62 moves the press roller 61 in the transport direction (+X-axis direction) and the opposite direction to the transport direction (−X-axis direction), while pressing the press roller 61 toward a vertical direction lower side (−Z-axis side). The medium 95 that has been transported from the transport roller 22 and superimposed on the endless belt 23 is pressed against the endless belt 23 between the press roller 61 and the roller support section 63. The medium 95 can accordingly be stuck securely to the adhesive layer 29 provided to the surface 23*a* of the endless belt 23, thereby enabling the medium 95 to be prevented from lifting off the endless belt 23.

The printing apparatus 100 includes the washer unit 50 that washes the endless belt 23. Specifically, the washer unit 50 is configured by a washer section 51, a pressing section 52, and a moving section 53. The moving section 53 is capable of moving the washer unit 50 along the floor surface 99 as a unit, and of fixing the washer unit 50 at a specific position. The washer unit 50 is disposed between the belt-rotated roller 24 and the belt drive roller 25 in the X-axis direction.

The pressing section 52 is, for example, a raising and lowering device configured by air cylinders 56 and ball bushes 57, and is capable of moving the washer section 51, provided at an upper portion of the pressing section 52, between a washing position and a retracted position. The washing position is a position where a washing roller 58 and a blade 55 abut the endless belt 23. The retracted position is a position where the washing roller 58 and the blade 55 are separated from the endless belt 23. The surface (support face) 23*a* of the endless belt 23 entrained between the belt-rotated roller 24 and the belt drive roller 25 in a state applied with a specific tension is washed from below (the −Z-axis direction) by the washer section 51 at the washing position. Note that FIG. 1 illustrates a case in which the washer section 51 has been raised and is disposed at the washing position.

The washer section 51 includes a washing tank 54, the washing roller 58, and the blade 55. The washing tank 54 is a tank that stores a washer liquid employed to wash away ink or foreign objects that have adhered to the surface 23*a* of the endless belt 23, and the washing roller 58 and the blade 55 are provided inside the washing tank 54. Water and a water-soluble solvent (such as an aqueous alcohol solution), for example, may be employed as the washer liquid. A surfactant or anti-foaming agent may be added as necessary.

A lower side (−Z-axis side) of the washing roller 58 is immersed in the washer liquid stored in the washing tank 54. When the washing roller 58 rotates at the washing position, the washer liquid is brought to the surface 23*a* of the endless belt 23, and the washing roller 58 and the endless belt 23 slide against each other. Ink, fibers of the fabric serving as the medium 95 that have adhered to the endless belt 23, and the like are accordingly removed by the washing roller 58.

The blade 55 may, for example, be formed from a flexible material such as silicone rubber. The blade 55 is provided further to the downstream side than the washing roller 58 in the transport direction of the endless belt 23. The endless belt 23 and the blade 55 slide against each other so as to remove washer liquid remaining on the surface 23*a* of the endless belt 23.

The printing section 40 ejects droplets of ink, serving as a liquid, toward the medium 95 retained on the endless belt 23.

As illustrated in FIG. 2 and FIG. 3, the printing section 40 includes a head unit 42, a carriage 43 to which the head unit 42 is mounted, and the like. The head unit 42 is configured by plural sub-units, and the present embodiment describes an example in which the head unit 42 is configured by three of the sub-units 42*a*, 42*b*, 42*c*. The head unit 42 is moved back and forth along the Y-axis direction by a carriage transport section 93, described later.

The carriage transport section 93 moves the head unit 42 back and forth along the Y-axis direction, together with the carriage 43. The carriage transport section 93 is provided above the endless belt 23 (on the +Z-axis side). The carriage transport section 93 includes a pair of guide rails 93*a*, 93*b* extending along the Y-axis direction, and carriage position detection devices (not illustrated in the drawings) provided along the guide rails 93*a*, 93*b*.

The guide rails 93*a*, 93*b* span between upright frame portions 92*a*, 92*b* running in the X-axis direction at the outside of the endless belt 23. The guide rails 93*a*, 93*b* support the carriage 43. The carriage 43 is guided in the Y-axis direction by the guide rails 93*a*, 93*b*, and is supported by the guide rails 93*a*, 93*b* in a state capable of moving back and forth along the Y-axis direction. The carriage position detection devices extend along the guide rails 93*a*, 93*b*, and are capable of detecting the position of the carriage 43 in the Y-axis direction.

The carriage transport section 93 includes a moving mechanism and a power source, not illustrated in the drawings. A device combining ball screws and ball nuts, a linear guiding mechanism, or the like may be employed as the moving mechanism. Moreover, the carriage transport section 93 is provided with motors (not illustrated in the drawings) serving as a power source that moves the carriage 43 along the Y-axis direction. Various types of motor, such as a stepping motor, a servomotor, or a linear motor, may be employed as the motor. The head unit 42 moves back and forth along the Y-axis direction together with the carriage 43 when the motor is driven under the control of the controller 1.

Head Unit

Figure 4:
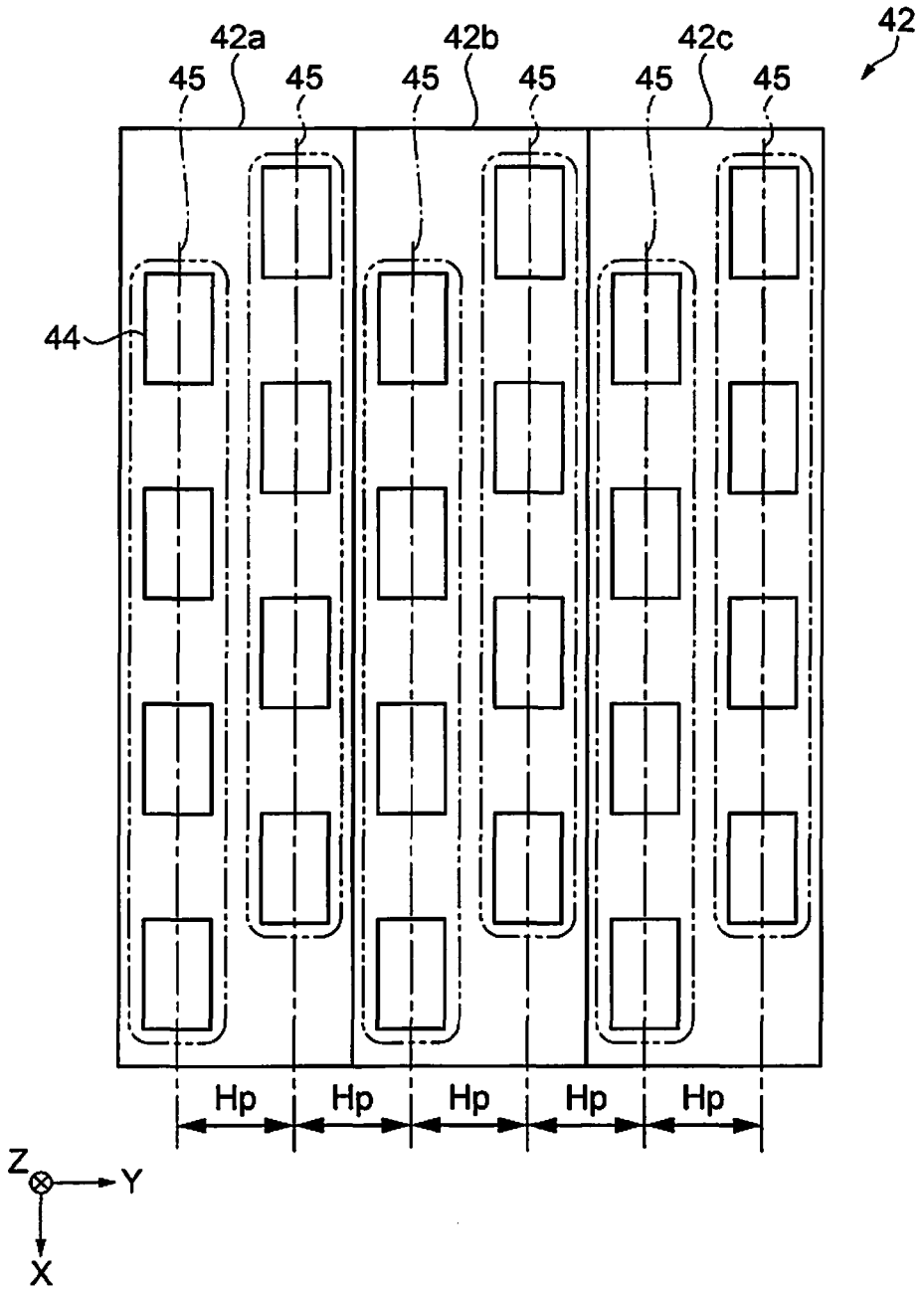
FIG. 4 is a plan view illustrating a schematic configuration of a head unit.

FIG. 4 is a plan view illustrating a schematic configuration of the head unit. FIG. 4 is a diagram of the head unit 42 in FIG. 2, as viewing the bottom face (the −Z-axis side) thereof. Explanation follows regarding ejection heads 44 provided to the head unit 42, with reference to FIG. 4. The head unit 42 includes the ejection heads 44 that eject the liquid onto the medium 95. The head unit 42 includes the plural sub-units 42*a*, 42*b*, 42*c*, each including ejection head rows 45 configured by plural of the ejection heads 44. The present embodiment describes an example in which each of the sub-units 42*a*, 42*b*, 42*c* includes eight of the ejection heads 44 disposed along the X-axis direction so as to be staggered across two rows. Namely, there are two of the ejection head rows provided in each of the sub-units 42*a*, 42*b*, 42*c*, such that the head unit 42 includes six ejection head rows 45. The respective ejection head rows 45 are disposed such that a spacing between the centers of the respective ejection head rows 45 is a specific uniformly spaced head pitch Hp.

Figure 5:
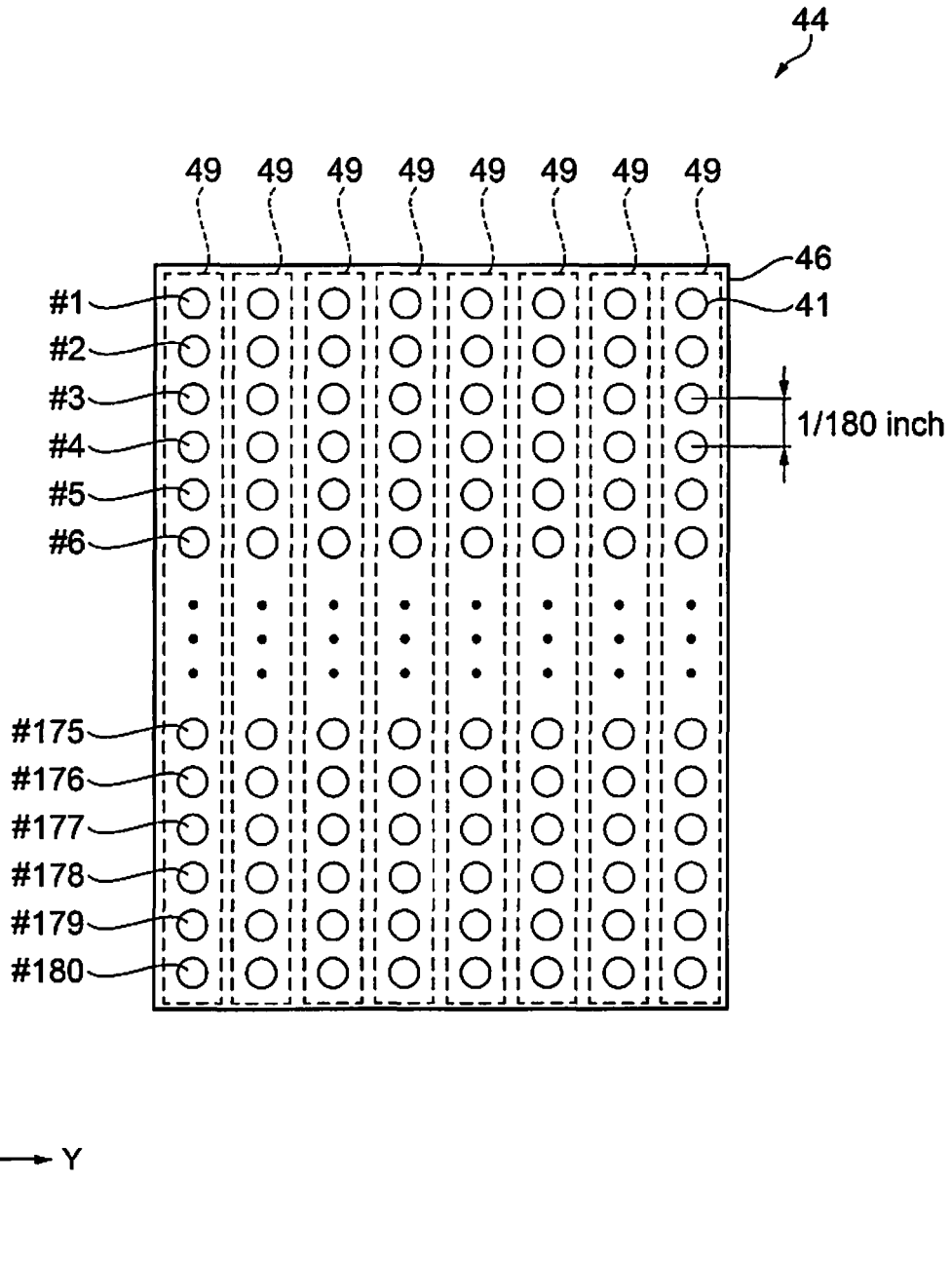
FIG. 5 is a plan view illustrating an example of an ejection head.
Figure 6:
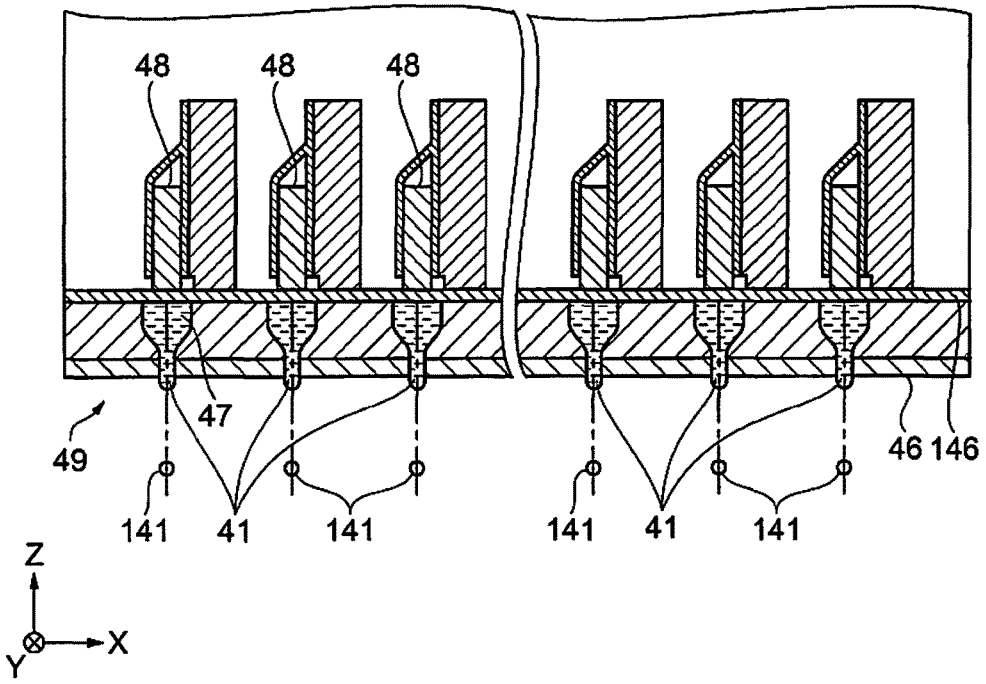
FIG. 6 is a cross-section illustrating internal configuration of nozzles.

FIG. 5 is a plan view illustrating an example of an ejection head. FIG. 6 is a cross-section illustrating internal configuration of nozzles.

As illustrated in FIG. 5, each ejection head 44 is provided with eight nozzle rows 49. A lower face (the face on the −Z-axis side in FIG. 3) of the ejection head 44 is provided with a nozzle plate 46 in which ejection outlets of nozzles 41 are opened. The eight nozzle rows 49 eject, for example, cyan, magenta, yellow, and black ink.

Each of the nozzle rows 49 is, for example, provided with 180 of the nozzles 41 (from nozzle #1 to nozzle #180) in a row along the X-axis direction at a nozzle pitch giving 180 dots per inch (dpi). Note that the number of the nozzles 41, the number of the nozzle rows 49, and the types of ink given are merely examples, and there is no limitation thereto.

As illustrated in FIG. 6, each of the ejection heads 44 includes a nozzle plate 46, and the nozzles 41 are formed in the nozzle plate 46. Cavities 47 in communication with the nozzles 41 are disposed at an upper side (+Z-axis side) of the nozzle plate 46 at positions corresponding to the nozzles 41. Ink is supplied into the cavities 47 of the nozzles 41 from an ink supply section, not illustrated in the drawings.

A diaphragm 146 that oscillates in an up-down direction (±Z-axis direction) to increase and decrease the internal volume of the cavities 47, and piezoelectric elements 48 that extend and contract in the up-down direction so as to oscillate the diaphragm 146, are provided at the upper side (+Z-axis side) of the cavities 47. The piezoelectric elements 48 extend and contract in the up-down direction so as to oscillate the diaphragm 146, and the diaphragm 146 increases and decreases the volume inside the respective cavities 47 so as to pressurize the cavities 47. The pressure inside the cavities 47 accordingly fluctuates, and the ink supplied into the cavities 47 is ejected through the nozzles 41.

When the ejection heads 44 receive a drive signal to control drive of the piezoelectric elements 48, the piezoelectric elements 48 extend, such that the diaphragm 146 reduces the internal volume of the cavities 47. Commensurate with the reduction in volume, ink is accordingly ejected from the nozzles 41 as liquid droplets 141. Note that the present embodiment describes an example in which vertically oscillating piezoelectric elements 48 are employed as a pressurizing unit. However, there is no limitation thereto. For example, flexural deformation type piezoelectric elements formed by stacking a lower electrode, a piezoelectric body layer, and an upper electrode may be employed. Moreover, what is referred to as an electrostatic actuator that generates static electricity between a diaphragm and an electrode, and deforms the diaphragm with the static electricity to eject liquid droplets from the nozzles, may be employed as a pressure generation unit. Moreover, a head may have a configuration employing a heat generating body to generate bubbles inside the nozzles, such that ink is ejected as liquid droplets due to the bubbles.

Maintenance Sections

Returning to FIG. 2 and FIG. 3, explanation follows regarding maintenance sections 70 and a cap section 81. The printing apparatus 100 includes plural of the maintenance sections 70 that successively perform maintenance on the sub-units 42*a*, 42*b*, 42*c*, and also includes the cap section 81. The maintenance sections 70 and the cap section 81 are provided on one side (the +Y-axis direction side in the present embodiment) of the endless belt 23 in the Y-axis direction along which the head unit 42 moves back and forth. In plan view as viewed from the +Z-axis direction, the maintenance sections 70 and the cap section 81 are provided at positions overlapping with the head unit 42 moving back and forth along the Y-axis direction. In the present embodiment, the plural maintenance sections 70 include a suction section 71 that applies suction to the ejection heads 44 (see FIG. 4), a wiping section 74 that removes liquid, and a flushing section 77 that ejects a liquid through the nozzles 41 of the ejection heads 44. On progression from a +Y-axis direction end portion toward the −Y-axis direction, the respective maintenance sections 70 and the cap section 81 are disposed in the sequence: cap section 81; suction section 71; wiping section 74; flushing section 77. The maintenance sections 70 and the cap section 81 include raising and lowering devices 94 configured by air cylinders or the like, and during a maintenance operation, the maintenance sections 70 and the cap section 81 are raised to abutting positions abutting the ejection heads 44, or close proximity positions in close proximity to the ejection heads 44.

The cap section 81 is a device that covers the ejection heads 44. Sometimes, the ink ejected from the nozzles 41 (see FIG. 6) provided to the ejection heads 44 has volatile properties. If solvent in the ink present inside the ejection heads 44 were to vaporize through the nozzles 41, the viscosity of the ink could change, causing the nozzles 41 to become clogged. The cap section 81 includes cap bodies 82. The cap bodies 82 cover the ejection heads 44, thereby preventing the nozzles 41 from clogging.

The suction section 71 is a device that covers the ejection heads 44 and sucks out ink from inside the ejection heads 44. The suction section 71 is provided with cap bodies 72 and a negative pressure pump, not illustrated in the drawings. In a state in which the ejection heads 44 are covered by the cap bodies 72, a suction operation is performed to apply negative pressure to the inside of the cap bodies 72, and suck out ink from inside the ejection heads 44. This thereby enables air bubbles, foreign objects, and the like inside the ejection heads 44 to be removed. Ejection defects due to air bubbles or foreign objects can accordingly be repaired or prevented.

The wiping section 74 is a device to wipe the nozzle plate 46 of the ejection heads 44 (see FIG. 6). The nozzle plate 46 is a member disposed at a face of the head unit 42 on a side facing the medium 95. If dried ink or foreign objects were to adhere to the nozzle plate 46, ejection defects could arise, causing liquid droplets to land on the medium 95 at unplanned locations. The wiping section 74 includes blades 75 and a wiping motor (not illustrated in the drawings) that moves the blades 75 along the X-axis direction. The wiping section 74 performs a wiping operation in which the blades 75 are used to wipe off ink and foreign objects that have adhered to the nozzle plate 46, thereby enabling ejection defects to be repaired or prevented.

The flushing section 77 is a device to trap liquid droplets ejected from the nozzles 41. The flushing section 77 includes flushing boxes 78 containing porous fibers, such as felt. The flushing section 77 traps liquid droplets ejected from the nozzles 41 provided to the ejection heads 44 when ink flow paths inside the ejection heads 44 are cleaned. When ink inside the ejection heads 44 has increased in viscosity, or when solid matter has been mixed in, a flushing operation to eject liquid droplets through the nozzles 41 removes the ink that has increased in viscosity or solid matter, thereby regulating the state of the ink. This thereby enables ejection defects due to ink that has increased in viscosity, or solid matter, to be repaired or prevented.

Figure 7:
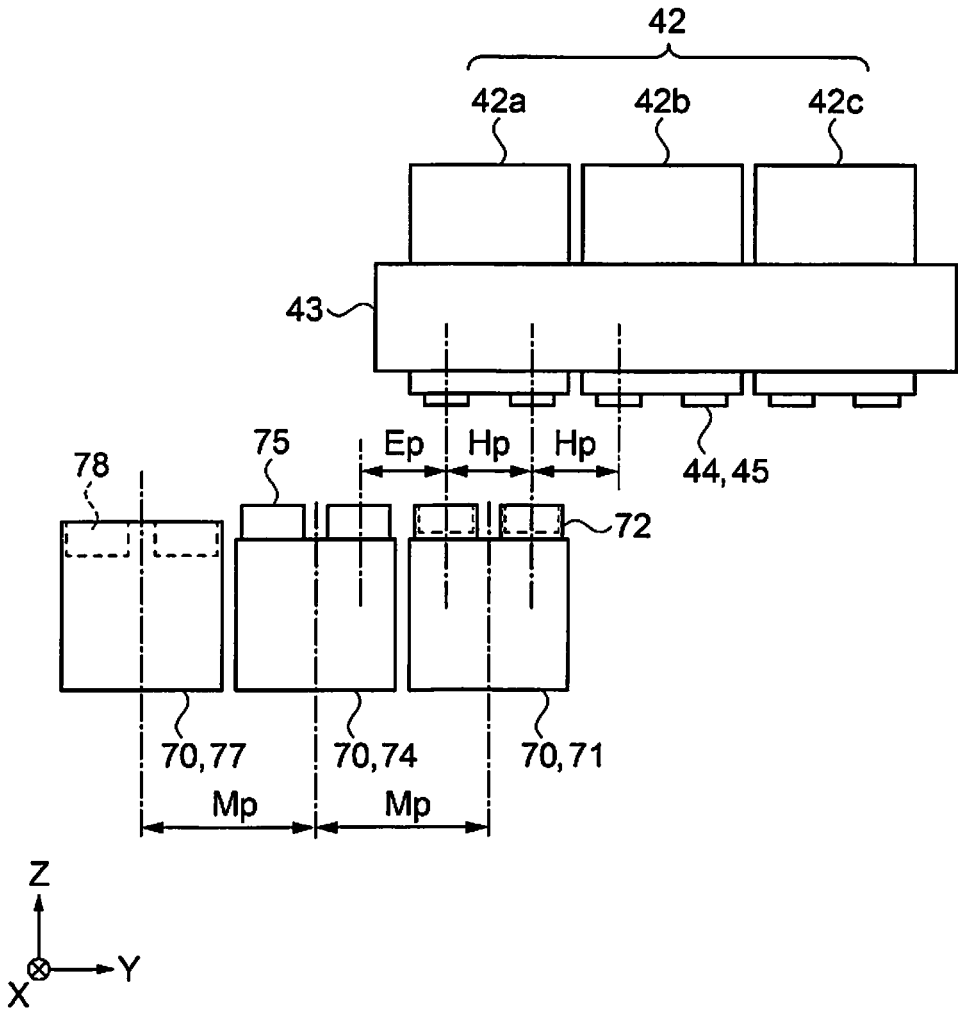
FIG. 7 is a side view illustrating positional relationships between a head unit and maintenance sections.

FIG. 7 is a side view illustrating a positional relationship between the head unit and the maintenance sections. Explanation follows regarding placement of the maintenance sections 70, with reference to FIG. 7.

The spacing between the centers of each of the ejection head rows 45 provided to the head unit 42 is set to the specific head pitch Hp.

The suction section 71, serving as a maintenance section 70, includes the cap bodies 72 arranged side-by-side in two rows at a spacing of the head pitch Hp in the Y-axis direction, corresponding to the two ejection head rows 45 provided to each of the sub-units 42*a*, 42*b*, 42*c*.

The wiping section 74, serving as a maintenance section 70, includes the blades 75 arranged side-by-side in two rows at a spacing of the head pitch Hp in the Y-axis direction, corresponding to the two ejection head rows 45 provided to each of the sub-units 42*a*, 42*b*, 42*c*.

The flushing section 77, serving as a maintenance section 70, includes the flushing boxes 78 arranged side-by-side in two rows at a spacing of the head pitch Hp in the Y-axis direction, corresponding to the two ejection head rows 45 provided to each of the sub-units 42*a*, 42*b*, 42*c*.

A spacing between the centers of mutually adjacent maintenance sections 70 (a maintenance pitch Mp) is set as an integer multiple (positive integer multiple) of the product of the head pitch Hp with the number of the ejection head rows 45 provided to each of the sub-units 42*a*, 42*b*, 42*c*. In the present embodiment, the maintenance pitch Mp is twice (2 rows×1) the head pitch Hp. Accordingly, a spacing (referred to below as the "area spacing Ep") between a cap body 72 of the suction section 71 and the adjacent blade 75 of the wiping section 74 corresponds to the head pitch Hp. Moreover, the area spacing Ep between a blade 75 of the wiping section 74 and the adjacent flushing box 78 of the flushing section 77 corresponds to the head pitch Hp. This thereby enables the respective maintenance sections 70 (the suction section 71, the wiping section 74, and the flushing section 77) to be aligned with the respective sub-units 42*a*, 42*b*, 42*c* at the same time by moving the head unit 42 by a movement amount of twice the head pitch Hp. Note that in the present specification, the meaning of expressions such as "aligning" with respect to the positions, spacings, and the like of the respective configurations is not restricted to perfect alignment only, and encompasses margins of error of a level permissible from the perspective of the apparatus performance, and margins of error of a level that may arise during manufacture of the apparatus.

Electrical Configuration

Figure 8:
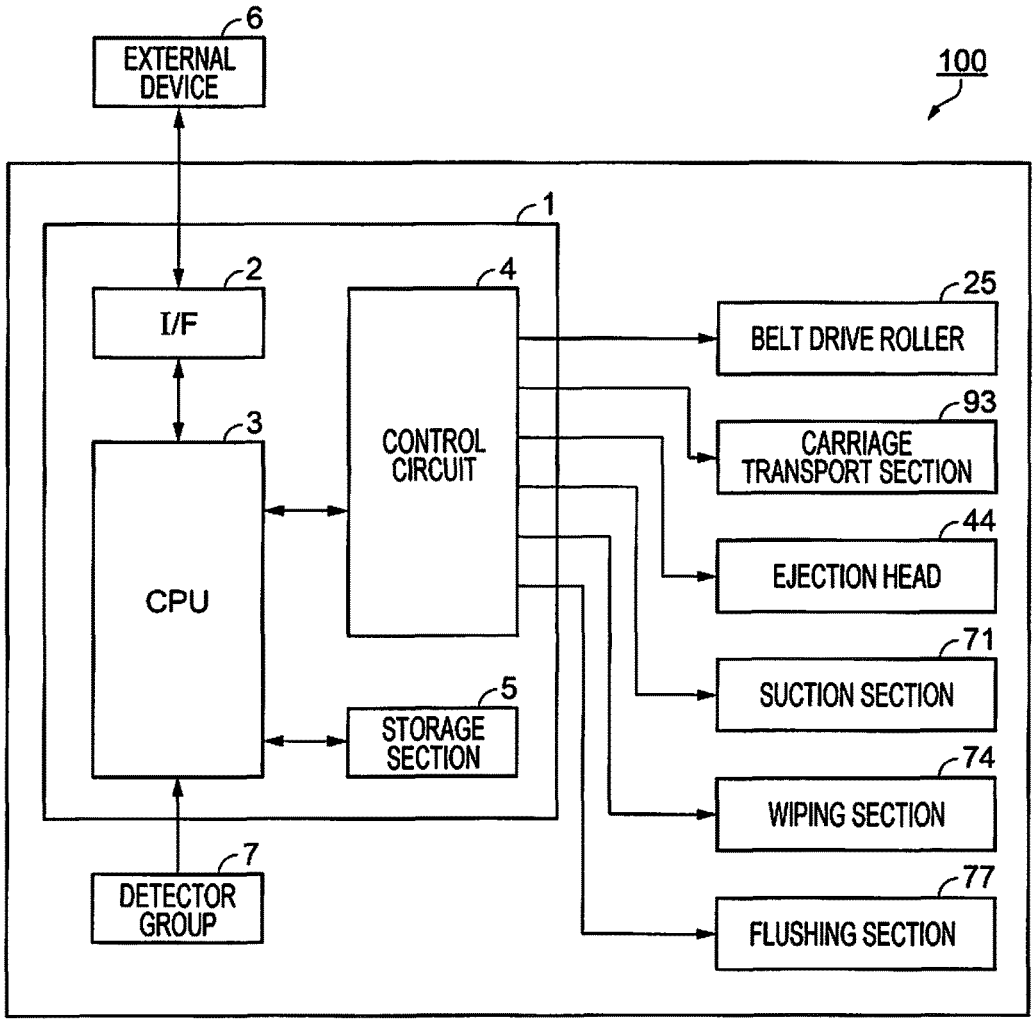
FIG. 8 is an electrical block diagram illustrating an electrical configuration of a printing apparatus.

FIG. 8 is an electrical block diagram illustrating an electrical configuration of the printing apparatus. Explanation follows regarding the electrical configuration of the printing apparatus 100, with reference to FIG. 8.

The printing apparatus 100 includes the controller 1. The controller 1 is a control unit that controls the printing apparatus 100. The controller 1 is configured including a control circuit 4, an interface section (I/F) 2, a Central Processing Unit (CPU) 3, and a storage section 5. The interface section 2 exchanges data with an external device 6 that handles images, such as a computer, and with the printing apparatus 100. The CPU 3 is a computation processing device that processes signals input from various detector groups 7, and controls the overall printing apparatus 100.

The storage section 5 secures a region for storing CPU 3 programs, a work area, and the like, and includes storage elements such as Random Access Memory (RAM) and Electrically Erasable Programmable Read-Only Memory (EEPROM).

The CPU 3 uses the control circuit 4 to control various motors provided to the belt drive roller 25 so as to move the medium along the X-axis direction. The CPU 3 uses the control circuit 4 to control various motors provided to the carriage transport section 93 to move the carriage 43, to which the head unit 42 is mounted, along the Y-axis direction. The CPU 3 uses the control circuit 4 to control the voltage of the piezoelectric elements 48 provided to the head unit 42 (ejection heads 44) to eject the liquid droplets 141 from the nozzles 41 onto the medium 95.

The CPU 3 uses the control circuit 4 to control the raising and lowering device 94 and the negative pressure pump provided to the suction section 71 so as to perform maintenance of the ejection heads 44. The CPU 3 uses the control circuit 4 to control motors that move the raising and lowering device 94 and the blades 75 provided to the wiping section 74 so as to perform maintenance of the ejection heads 44. The CPU 3 uses the control circuit 4 to control the raising and lowering device 94 provided to the flushing section 77 so as to perform maintenance of the ejection heads 44. The CPU 3 also uses the control circuit 4 to control various devices that are not illustrated in the drawings.

Figure 9:
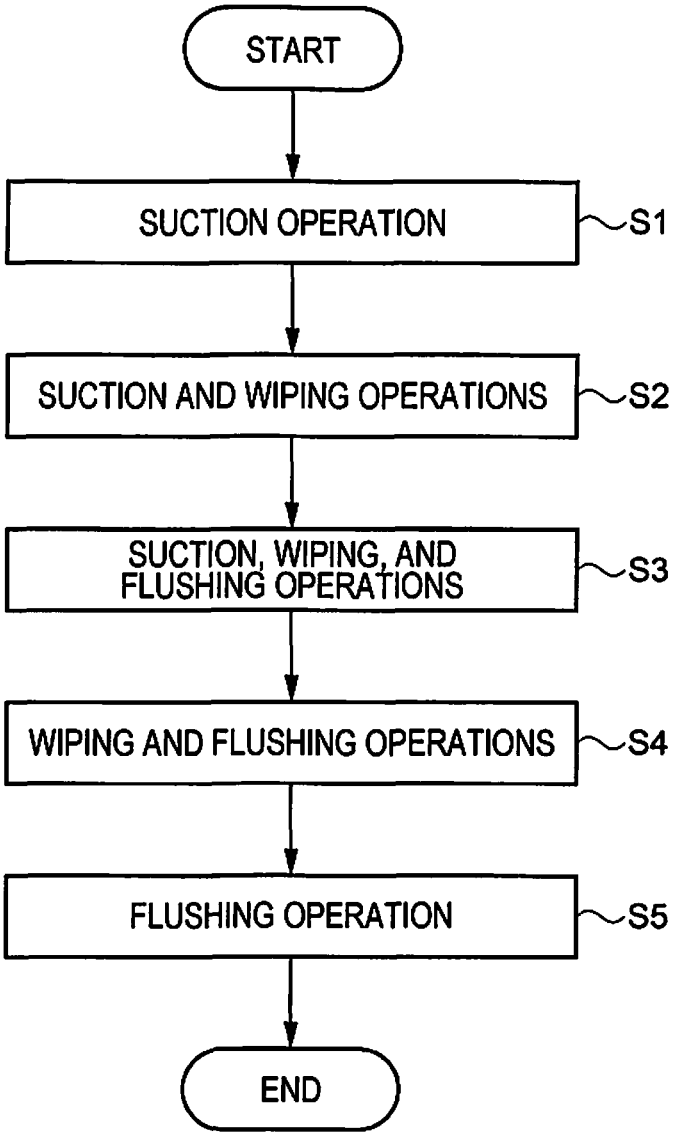
FIG. 9 is a flowchart to explain maintenance operations.
Figure 10:
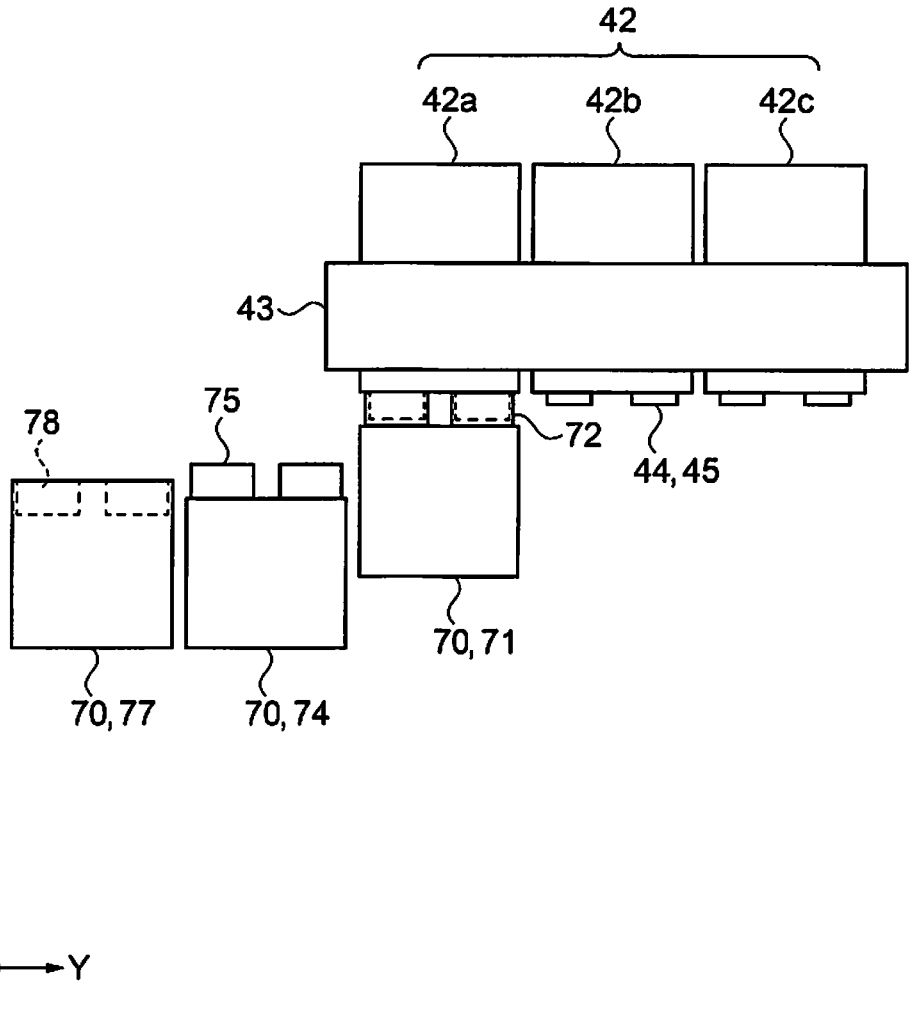
FIG. 10 is a side view to explain positional relationships between a head unit and maintenance sections during main processes.
Figure 11:
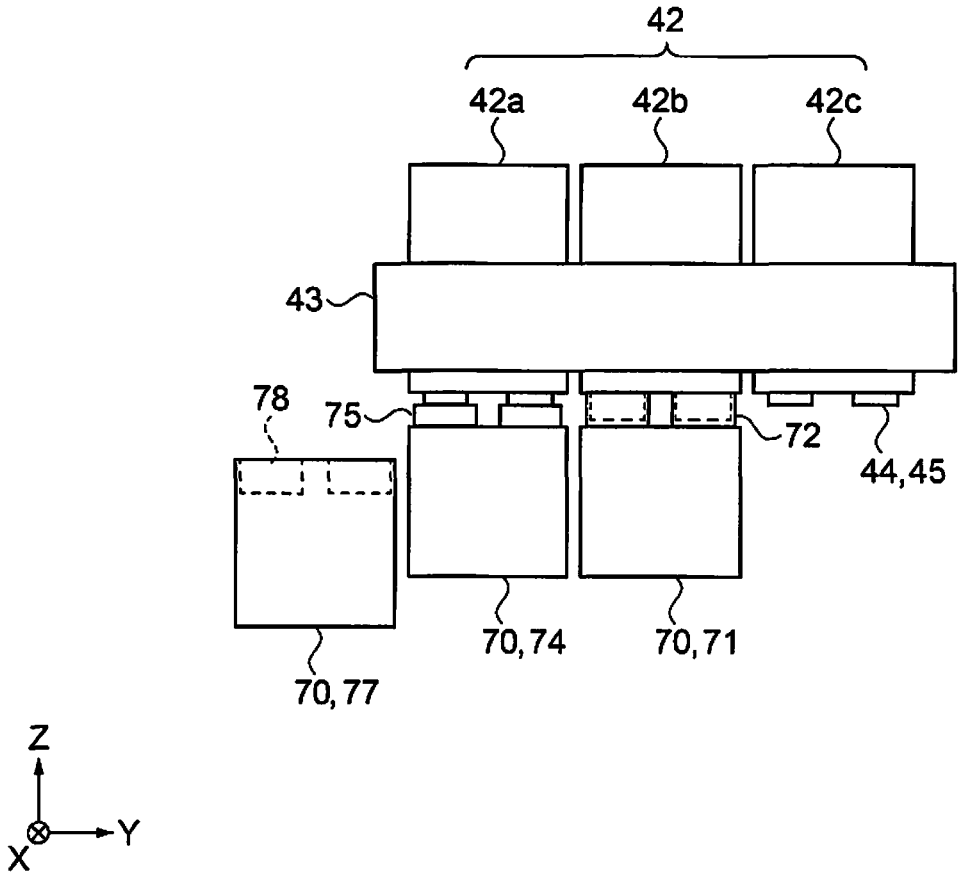
FIG. 11 is a side view to explain positional relationships between a head unit and maintenance sections during main processes.
Figure 12:
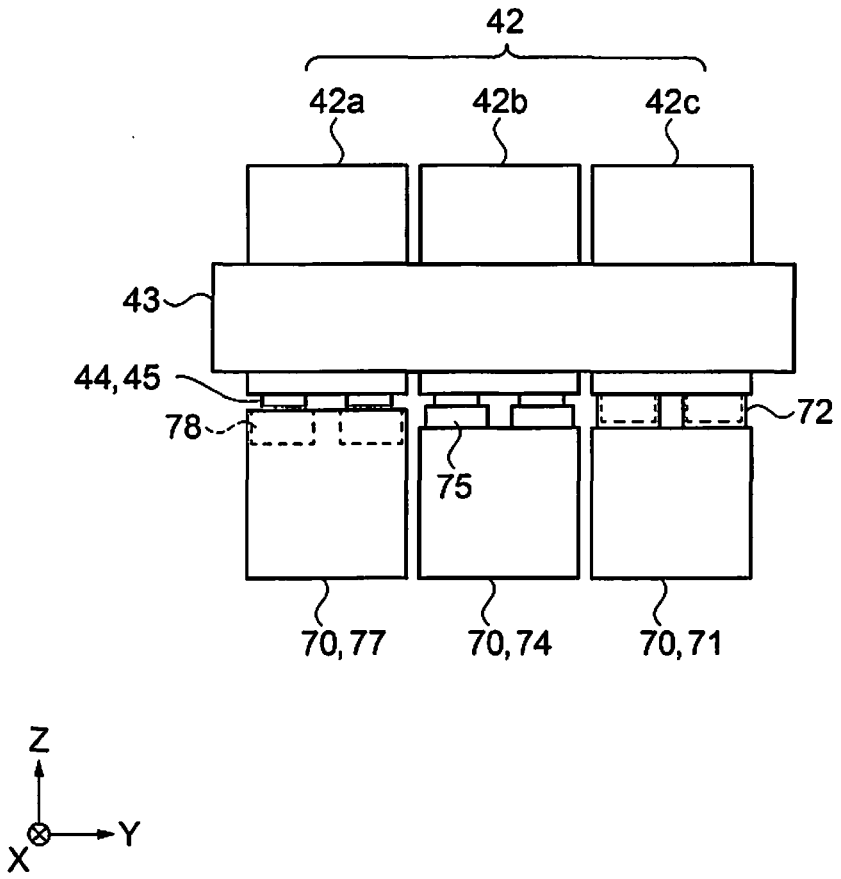
FIG. 12 is a side view to explain positional relationships between a head unit and maintenance sections during main processes.

FIG. 9 is a flowchart to explain a maintenance operation. FIG. 10 to FIG. 12 are side views to explain positional relationships between the head unit and the maintenance sections during main processes.

At step S1, the suction operation is performed. As illustrated in FIG. 10, the controller 1 controls the carriage transport section 93 to move the carriage 43 to a position where the sub-unit 42*a* and the suction section 71 are aligned with each other. The controller 1 then controls the raising and lowering device 94 and the negative pressure pump of the suction section 71 so as to cover the ejection heads 44 of the sub-unit 42*a* with the cap bodies 72, and suck out the ink from inside the ejection heads 44.

At step S2, the suction operation and the wiping operation are performed. As illustrated in FIG. 11, the controller 1 controls the carriage transport section 93 to move the carriage 43 by twice the head pitch Hp in the −Y-axis direction. Accordingly, the positions of the sub-unit 42*a* and the wiping section 74 align, and the positions of the sub-unit 42*b* and the suction section 71 align. The controller 1 then controls the raising and lowering device 94 and the wiping motor of the wiping section 74 such that the blades 75 abut and slide against the ejection heads 44 of the sub-unit 42*a*. At the same time, the controller 1 controls the raising and lowering device 94 and the negative pressure pump of the suction section 71 so as to cover the ejection heads 44 of the sub-unit 42*b* with the cap bodies 72, and suck out the ink from inside the ejection heads 44.

At step S3, the suction operation, the wiping operation, and the flushing operation are performed. As illustrated in FIG. 12, the controller 1 controls the carriage transport section 93 to move the carriage 43 by twice the head pitch Hp in the −Y-axis direction. Accordingly, the positions of the sub-unit 42*a* and the flushing section 77 align, the positions of the sub-unit 42*b* and the wiping section 74 align, and the positions of the sub-unit 42*c* and the suction section 71 align. The controller 1 then controls the raising and lowering device 94 of the flushing section 77 and controls the ejection heads 44, such that the flushing section 77 is placed in close proximity to the ejection heads 44 of the sub-unit 42*a*, and ink is ejected from the nozzles 41 of the sub-unit 42*a*. At the same time, the controller 1 controls the raising and lowering device 94 and the wiping motor of the wiping section 74 such that the blades 75 abut and slide against the ejection heads 44 of the sub-unit 42*b*. Also at the same time, the controller 1 controls the raising and lowering device 94 and the negative pressure pump of the suction section 71 so as to cover the ejection heads 44 of the sub-unit 42*c* with the cap bodies 72, and suck out the ink from inside the ejection heads 44.

At step S4, the wiping operation and the flushing operation are performed. The controller 1 controls the carriage transport section 93 to move the carriage 43 by twice the head pitch Hp in the −Y-axis direction. Accordingly, the positions of the sub-unit 42*b* and the flushing section 77 align, and the positions of the sub-unit 42*c* and the wiping section 74 align. The controller 1 then controls the raising and lowering device 94 of the flushing section 77 and controls the ejection heads 44, such that the flushing section 77 is placed in close proximity to the ejection heads 44 of the sub-unit 42*b*, and ink is ejected from the nozzles 41 of the sub-unit 42*b*. At the same time, the controller 1 controls the raising and lowering device 94 and the wiping motor of the wiping section 74 such that the blades 75 abut and slide against the ejection heads 44 of the sub-unit 42*c*.

At step S5, the flushing operation is performed. The controller 1 controls the carriage transport section 93 to move the carriage 43 by twice the head pitch Hp in the −Y-axis direction. Accordingly, the positions of the sub-unit 42*c* and the flushing section 77 align. The controller 1 then controls the raising and lowering device 94 of the flushing section 77 and the ejection heads 44, such that the flushing section 77 is placed in close proximity to the ejection heads 44 of the sub-unit 42*c*, and ink is ejected from the nozzles 41 of the sub-unit 42*c*.

Since the related printing apparatus does not have a configuration in which the respective maintenance sections 70 (the suction section 71, the wiping section 74, and the flushing section 77) align with the sub-units 42*a*, 42*b*, 42*c* at the same time, the maintenance operations are performed singly on the individual sub-units. Specifically, the suction operation, the wiping operation, and the flushing operation are performed on the sub-unit 42*a*, then the suction operation, the wiping operation, and the flushing operation are performed on the sub-unit 42*b*, and then the suction operation, the wiping operation, and the flushing operation are performed on the sub-unit 42*c*. This results in a long time being required for maintenance of the head unit 42, and a drop in the operation efficiency of the printing apparatus.

In the printing apparatus 100 of the present embodiment, the plural maintenance sections 70 (the suction section 71, the wiping section 74, and the flushing section 77) are configured capable of performing different maintenance operations on the plural sub-units 42*a*, 42*b*, 42*c* at the same time. This thereby enables the maintenance time to be made shorter, without altering the basic configuration of the printing apparatus 100. Note that in the present embodiment, explanation has been given regarding the example of the ink jet printing apparatus 100 that prints onto the medium 95; however, there is no limitation thereto. The present embodiment may be also applied to ink jet printing apparatuses with serial heads that eject ink while moving along a width direction of the medium.

In the present embodiment, explanation has been given regarding an example in which the head unit 42 is configured by the three sub-units 42*a*, 42*b*, 42*c*, and each of the sub-units 42*a*, 42*b*, 42*c* is provided with two of the ejection head rows 45. However, there is no limitation thereto. In cases in which the head unit is configured from several sub-units, and the maintenance pitch Mp is set to an integer multiple of the product of the head pitch Hp with the number of the ejection head rows 45, moving the head unit by the maintenance pitch Mp aligns each of the respective maintenance sections 70 (the suction section 71, the wiping section 74, and the flushing section 77) with one of the sub-units. This thereby enables different maintenance operations to be performed on plural sub-units at the same time, thereby enabling the maintenance time to be made shorter.

As described above, the printing apparatus 100 according to the present embodiment enables the following advantageous effects to be obtained.

The maintenance pitch Mp between mutually adjacent maintenance sections 70 is set to an integer multiple of the product of the head pitch Hp with the number of the ejection head rows 45 provided to each of the sub-units 42*a*, 42*b*, 42*c* (2 rows×integer 1=twice). Moving the head unit 42 by the maintenance pitch Mp enables plural of the maintenance sections 70 to be aligned with the different sub-units 42*a*, 42*b*, 42*c*. This thereby enables the maintenance sections 70 to perform different maintenance operations on the plural sub-units at the same time, without altering the basic configuration of the apparatus. The printing apparatus 100 with improved operation efficiency can accordingly be provided without incurring an increase in the cost of the apparatus.

The maintenance sections 70 include the suction section 71. This thereby enables air bubbles, foreign objects, and the like inside the ejection heads 44 to be removed by the suction operation to suck out ink from inside the ejection heads 44. Ejection defects due to air bubbles or foreign objects can accordingly be repaired or prevented.

The maintenance sections 70 further include the wiping section 74. Ejection defects due to ink, foreign objects, and the like that have adhered to the nozzle plate 46 can accordingly be repaired or prevented by performing the wiping operation to wipe the nozzle plate 46.

The maintenance sections 70 further include the flushing section 77. Ejection defects due to ink that has increased in viscosity, or solid matter, can accordingly be repaired or prevented by performing the flushing operation to eject liquid droplets from the nozzles 41.

Modified Example

Figure 13:
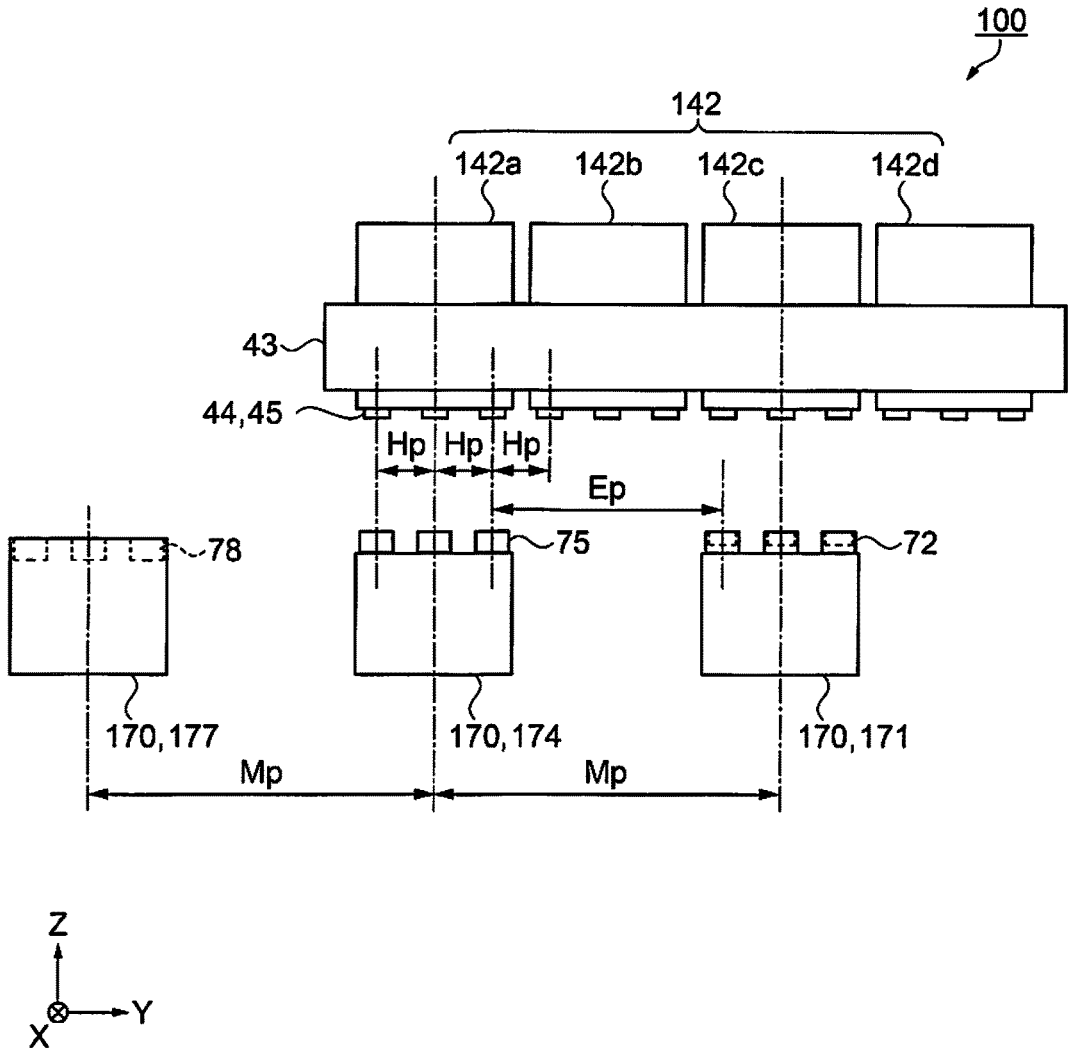
FIG. 13 is a side view illustrating positional relationships between a head unit and maintenance sections according to a modified example.

FIG. 13 is a side view illustrating positional relationships between a head unit and maintenance sections according to a modified example. In the present modified example, the configuration of the head unit and the placement positions of the maintenance sections differ to those in the embodiment described above.

Explanation follows regarding a printing apparatus 100 according to the modified example, with reference to FIG. 13. Note that configuration locations similar to those of the embodiment are appended with the same reference numerals, and duplicate explanation thereof is omitted.

As illustrated in FIG. 13, a head unit 142 is configured by four sub-units 142*a*, 142*b*, 142*c*, 142*d*. There are three ejection head rows provided to each of the sub-units 142*a*, 142*b*, 142*c*, 142*d*, such that the head unit 142 includes 12 of the ejection head rows 45. The spacing between the centers of the ejection head rows 45 provided to the head unit 142 is set to a specific head pitch Hp.

A suction section 171, serving as a maintenance section 170, includes the cap bodies 72 arranged side-by-side in three rows at a spacing of the head pitch Hp in the Y-axis direction, corresponding to the three ejection head rows 45 provided to each of the sub-units 142*a*, 142*b*, 142*c*, 142*d*.

A wiping section 174, serving as a maintenance section 170, includes the blades 75 arranged side-by-side in three rows at a spacing of the head pitch Hp in the Y-axis direction, corresponding to the three ejection head rows 45 provided to each of the sub-units 142*a*, 142*b*, 142*c*, 142*d*.

A flushing section 177, serving as a maintenance section 170, includes the flushing boxes 78 arranged side-by-side in three rows at a spacing of the head pitch Hp in the Y-axis direction, corresponding to the three ejection head rows 45 provided to each of the sub-units 142*a*, 142*b*, 142*c*, 142*d*.

A spacing between the centers of mutually adjacent maintenance sections 170 (a maintenance pitch Mp) is set as an integer multiple (positive integer multiple) of the product of the head pitch Hp with the number of the ejection head rows 45 provided to each of the sub-units 142*a*, 142*b*, 142*c*, 142*d*. In the present modified example, the maintenance pitch Mp is set to six times (3 rows×integer 2) the head pitch Hp. Accordingly, a spacing (referred to below as the "area spacing Ep") between a cap body 72 of the suction section 171 and the adjacent blade 75 of the wiping section 174 corresponds to an integer multiple of the head pitch Hp. Moreover, the area spacing Ep between a blade 75 of the wiping section 174 and the adjacent flushing box 78 of the flushing section 177 corresponds to an integer multiple of the head pitch Hp. Accordingly, two out of the suction section 171, the wiping section 174, and the flushing section 177 aligned with two out of the respective sub-units 142*a*, 142*b*, 142*c*, 142*d* when the head unit 142 is moved by three times the head pitch Hp. FIG. 13 illustrates a state in which the wiping section 174 and the sub-unit 142*a* are aligned with each other, and the suction section 171 and the sub-unit 142*c* are aligned with each other at the same time.

The printing apparatus 100 of the present modified example enables different maintenance operations to be performed on two of the sub-units at the same time when two out of the suction section 171, the wiping section 174, and the flushing section 177 are aligned with two out of the sub-units 142*a*, 142*b*, 142*c*, 142*d*. This thereby enables the maintenance time to be made shorter.

A printing apparatus according to the present application example includes ejection heads that eject a liquid onto a medium, plural sub-units each including an ejection head row configured by plural of the ejection heads, and plural maintenance sections that sequentially perform maintenance on the sub-units. For a head pitch that is a spacing between centers of the ejection head rows, a spacing between centers of mutually adjacent of the maintenance sections is an integer multiple of the product of the head pitch with the number of the ejection head rows provided to each of the sub-units.

According to the present application example, the spacing between the centers of mutually adjacent of the maintenance sections is set as an integer multiple of the product of the head pitch with the number of the ejection head rows provided to each of the sub-units. In other words, the respective maintenance sections are disposed according to the head pitch. Each of the plural maintenance sections is provided at a position that aligns with one sub-unit out of the plural sub-units when the respective sub-units are moved by an integer multiple of the product of the head pitch with the number of the ejection head rows provided to each of the sub-units. In the related printing apparatus, one maintenance section out of plural maintenance sections performs maintenance on a single sub-unit. The printing apparatus of the present application example is configured such that the plural maintenance sections can perform different maintenance operations on the plural sub-units at the same time. This thereby enables the maintenance time to be made shorter, without altering the basic configuration of the apparatus. A printing apparatus with improved operation efficiency can accordingly be provided without incurring an increase in the cost of the apparatus.

In the printing apparatus described in the above application example, preferably the plural maintenance sections include a suction section that applies suction to the ejection heads, a wiping section that removes the liquid, and a flushing section that ejects liquid from the ejection heads.

According to the present application example, the suction section removes air bubbles and foreign objects inside the ejection heads, thereby enabling ejection defects due to air bubbles or foreign objects to be repaired or prevented. Moreover, the wiping section removes dried ink or foreign objects from the surface of the ejection heads, thereby enabling ejection defects due to solid matter to be repaired or prevented. The flushing section ejects liquid from the ejection heads, thereby enabling ejection defects due to liquid that has increased in viscosity to be repaired or prevented.

In the printing apparatus described in the above application example, preferably there are two of the ejection head rows provided in each of the sub-units, and the spacing between centers of mutually adjacent of the maintenance sections is twice the head pitch.

According to the present application example, each of the sub-units is provided with two of the ejection head rows, and the spacing between the centers of mutually adjacent of the maintenance sections is twice the head pitch. Each of the maintenance sections is disposed according to the head pitch. The respective maintenance sections align with consecutive sub-units when the respective sub-units are moved in sequence by twice the head pitch. This thereby enables different maintenance to be performed on the consecutive sub-units at the same time, thereby enabling the maintenance time to be made shorter.

What is claimed is:

1. A printing apparatus comprising:

ejection heads configured to eject a liquid onto a medium;

a plurality of sub-units each including an ejection head row configured by a plurality of the ejection heads, the plurality of the sub-units including at least a first and second sub-units; and a plurality of maintenance sections configured to sequentially perform maintenance on the sub-units, the plurality of the maintenance sections having at least a first and second maintenance sections, the plurality of the maintenance sections being configured such that positions of the first and second maintenance sections are aligned with positions of the first and second sub-units, respectively, while the first and second maintenance sections perform the maintenance on the first and second sub-units, after the first and second maintenance sections perform the maintenance on the first and second sub-units, the first and second sub-units move in an intersecting direction that intersects with a direction along the ejection head row such that the second sub-unit is aligned with the first maintenance section and the first maintenance section performs the maintenance on the second sub-unit.

2. The printing apparatus of claim 1, wherein the plurality of the maintenance sections include a suction section configured to apply suction to the ejection heads, a wiping section configured to remove the liquid, and a flushing section configured to eject liquid from the ejection heads.

3. The printing apparatus of claim 1, wherein the plurality of the maintenance sections are configured to simultaneously perform different maintenance operations on the plurality of the sub-units as the maintenance.

4. The printing apparatus of claim 1, wherein for a head pitch that is a spacing between centers of the ejection head rows, a spacing between centers of mutually adjacent of the maintenance sections is an integer multiple of the product of the head pitch with the number of the ejection head rows provided to each of the sub-units.

5. The printing apparatus of claim 4, wherein each of the sub-units has two of the ejection head rows, and the spacing between centers of mutually adjacent of the maintenance sections is twice the head pitch.

6. The printing apparatus of claim 4, wherein the plurality of the maintenance sections include a suction section configured to apply suction to the ejection heads, a wiping section configured to remove the liquid, and a flushing section configured to eject liquid from the ejection heads.

7. The printing apparatus of claim 6, wherein each of the sub-units has two of the ejection head rows, and the spacing between centers of mutually adjacent of the maintenance sections is twice the head pitch.

* * * * *